United States Patent [19]

Bando

[11] Patent Number: 4,538,126

[45] Date of Patent: Aug. 27, 1985

[54] ELECTROMAGNETIC RELAY WITH SYMMETRIC REACTION

[75] Inventor: Yoshihide Bando, Kyoto, Japan

[73] Assignee: Omron Tateisi Electronics Co., Kyoto, Japan

[21] Appl. No.: 605,655

[22] Filed: Apr. 30, 1984

[30] Foreign Application Priority Data

Apr. 24, 1983 [JP] Japan ..... 58-64888[U]

[51] Int. Cl.[3] ..... H01H 50/04

[52] U.S. Cl. ..... 335/78; 335/82; 335/83

[58] Field of Search ..... 335/78, 79, 80, 81, 335/82, 83, 84, 85, 177, 179, 229, 230

[56] References Cited

U.S. PATENT DOCUMENTS

| | | | |
|---|---|---|---|
| 3,067,305 | 12/1962 | Stout et al. | 335/84 |
| 4,142,166 | 2/1979 | Arnoux | 335/81 |
| 4,191,937 | 3/1980 | Koehler et al. | 335/79 |

*Primary Examiner*—E. A. Goldberg
*Assistant Examiner*—George Andrews
*Attorney, Agent, or Firm*—Wegner & Bretschneider

[57] ABSTRACT

An electromagnetic relay includes a coil wound around a core both of whose ends project therefrom. A yoke extends parallel thereto, and each of its ends is formed with two pole pieces which extend towards and lie one on each side of an end of the core with a certain gap being defined therebetween. A connecting member extends parallel to the core and the yoke and is mounted so as to be movable transversely, and means are provided for establishing and breaking some electrical connection according to such transverse movement. There are provided two armature pieces, one for each end of the core and both fixed to the connecting member. Each armature piece includes a permanent magnet plate and two plates of magnetic material fixed to it so as generally to form a C shape with one of the magnetic material plates being magnetized to be a north pole and the other a south pole. Each of the two plates of magnetic material is inserted on one side of an end of the core between it and the opposing one of the pole pieces of the yoke, into the gap therebetween. The directions of magnetization of the armature pieces are oppositely oriented. Thereby, when the relay switches over, it does so without generating any off center jerking, and thus its mounting to a base is improved. Also the quality of the magnetic circuit, and the manufacturability of the relay, are improved.

5 Claims, 5 Drawing Figures

ELECTROMAGNETIC RELAY WITH SYMMETRIC REACTION

BACKGROUND OF THE INVENTION

The present invention relates to an electromagnetic relay, and more particularly relates to an electromagnetic relay in which switch contacts are switched over by movement of an armature assembly in response to the energization of an electromagnet, in which no asymmetric reaction force is produced when the device is switched.

There is a known type of electromagnetic relay, which will now be described. An electromagnetic coil is wound on a spool, and the spool is fixedly mounted to a yoke member which has a first end portion at one end of the spool and two end portions at the other end of the spool somewhat spaced apart from one another which constitute magnetic pole pieces. An iron core is inserted through the middle of the spool and is held in place by its one end being crimped to said first end portion of the yoke member; in this position, the other end of said iron core, which constitutes another magnetic pole piece, is held between the pole pieces constituted by said two other end portions of the yoke member, each of which lies to one side of said end of said iron core with a certain gap being defined therebetween. Thus, when the electromagnet is energized, a magnetic circuit is created, and the two pole pieces of the yoke are magnetized to become poles of a particular polarity, for example in the case of energization in a particular direction they become south poles, while the end of the iron core between them is magnetized to become a pole of the opposite polarity, i.e. in this example becomes a north pole. An armature piece is made up by two iron plates being joined together by a plate shaped permanent magnet in approximately a C-shaped configuration, with one of the iron plates being thus magnetized to be a north pole and the other a south pole. This armature piece is positioned with the two iron plates inserted into the aforementioned gaps between the poles defined by said other end portions of the yoke member and the pole defined by said end of said iron core, and is mounted on on a block member which can move from side to side so that the iron plates can move towards and away from said end of said iron core. Contacts are provided which are opened and closed according to said sideways motion of said block member, either directly or via spring pieces which are bent thereby. Depending on the configuration, sideways biasing may be applied to the block member.

Thus, when the coil is energized in said particular direction, the one of the pole pieces which is magnetized to be a north pole by the permanent magnet is attracted to the pole piece of the yoke on its one side and is repelled from the side of the end of the iron core on its other side, while on the other hand the other one of the pole pieces which is magnetized to be a south pole by the permanent magnet is repelled from the pole piece of the yoke on its one side and is attracted to the side of the end of the iron core on its other side; and thereby the block member is biased in a certain sideways direction, and moves so as to open or close certain of its contacts. On the other hand, when the coil is energized in the electrical direction opposite to said particular direction, the one of the pole pieces which is magnetized to be a north pole by the permanent magnet is repelled from the pole piece of the yoke on its one side and is attracted to the side of the end of the iron core on its other side, while on the other hand the other one of the pole pieces which is magnetized to be a south pole by the permanent magnet is attracted to the pole piece of the yoke on its one side and is repelled from the side of the end of the iron core on its other side; and thereby the block member is biased in the opposite sideways direction, and moves so as to close or open said certain of its contacts. (The position when the coil is not energized can be either of these positions or a position intermediate between them, depending on the biasing of the block member). Thereby the contacts are reliably and positively switched, and a good and efficient magnetic circuit with little loss of magnetic flux is provided.

However, this device has a shortcoming, in that the movement of the block member occurs to and fro along a line which is offset from the general center of the device including its center of gravity, which generally passes through or near the center of the electromagnetic coil. Therefore, when the relay performs switching action, an unbalanced and off center jerking force is caused to be applied to the base board such as a printed circuit board to which the relay is fitted, and this off center jerking force creates a jerking torque around the center of gravity the relay. This can give rise to various problems with regard to the fixing of the relay to the printed circuit board, and can mean that after a certain service life the fixing of the relay becomes loosened.

Another disadvantage of the construction outlined above is that, because the one end of the iron core is crimped to said first end portion of the yoke member, the integrity of the magnetic circuit is not perfectly assured. Such crimping, if imperfectly done, can greatly raise the magnetic resistance of the magnetic circuit, thus deteriorating relay performance. Yet in the outlined prior art construction the use of such crimping for fixing the end of the iron core to the yoke member is very much preferable from the point of view of convenience and cost of assembly.

An expedient that might be thought of for curing the above outlined unbalance problem might be to provide two of the relay construction detailed above mounted back to back, so that the two forces due to the movements of their armature assemblies were on opposite sides of their center of gravity and the unbalanced portions thereof canceled one another out; but this would increase the overall size and particularly the length of the device, and would increase its cost substantially. Further, this expedient would not solve the problem that the crimping can deteriorate the quality of the magnetic circuit.

SUMMARY OF THE INVENTION

Accordingly, it is the primary object of the present invention to provide an electromagnetic relay during the operation of which no off center jerking forces are generated.

It is a further object of the present invention to provide such an electromagnetic relay, which does not easily come loose from its mountings after some time in service.

It is a further object of the present invention to provide such an electromagnetic relay, which is reliable in service.

It is a further object of the present invention to provide such an electromagnetic relay, which can be manufactured so as to be consistent in its operational properties.

It is a further object of the present invention to provide such an electromagnetic relay, which can be manufactured easily and cheaply.

It is a yet further object of the present invention to provide such an electromagnetic relay, which is compact in size.

It is a yet further object of the present invention to provide such an electromagnetic relay, which particularly is short in its overall length.

According to the most general aspect of the present invention, these and other objects are accomplished by an electromagnetic relay, comprising: (a) a core made of magnetic material; (b) an electromagnetic coil wound around said core so that the two ends of said core project therefrom and constitute core end poles; (c) a yoke extending generally parallel to said core, each end of said yoke being formed with two pole pieces which extend towards the corresponding end pole of said core so as to lie one on each side thereof with a certain gap being defined therebetween; (d) a connecting member extending generally parallel to said core and said yoke and mounted so as to be movable transversely to its longitudinal axis; (e) means for establishing and breaking electrical connection according to movement of said connecting member transversely to its longitudinal axis; and (f) two armature pieces, one for each end of said core, both fixed to said connecting member, and each comprising a permanent magnet plate and two plates of magnetic material fixed to said permanent magnet plate so as generally to form a C shape with one of said magnetic material plates being magnetized to be a north pole and the other being magnetized to be a south pole, each of the two plates of magnetic material being inserted on one side of said end of said core between the side of said end of said core and the opposing one of said pole pieces of said yoke into said gap therebetween; (g) the directions of magnetization of said armature pieces being oppositely oriented.

According to such a structure, since the directions of magnetization of the armature pieces are opposite, when the electromagnetic coil is energized and one of the two ends of the core becomes a north pole while the other becomes a south pole, the armature pieces are both impelled in the same direction transverse to the longitudinal axis of the coil and the core, so that the connecting member as a whole is impelled transversely thereby to switch the electrical connections. This action is performed in a symmetrical fashion with respect to the center of gravity of the device, and thus does not generate any off center jerking. Thus the mounting of the relay to a base is improved, because no torsional vibrations are generated during repeating switching actions which might lead to its being loosened therefrom. Also, because no crimped construction is used, the quality of the magnetic circuit, and the manufacturablity of the relay, are improved. And it is maintained compact in size and particularly short in length.

BRIEF DESCRIPTION OF THE DRAWINGS

The present invention will now be shown and described with reference to the preferred embodiment thereof, and with reference to the illustrative drawings, which are all of them given purely for the purposes of explanation and exemplification only, and are not of them intended to be limitative of the scope of the present invention in any way. In the drawings, like parts and features are denoted by like reference symbols in the various figures thereof, and.

DESCRIPTION OF THE PREFERRED EMBODIMENT

Figure 1:
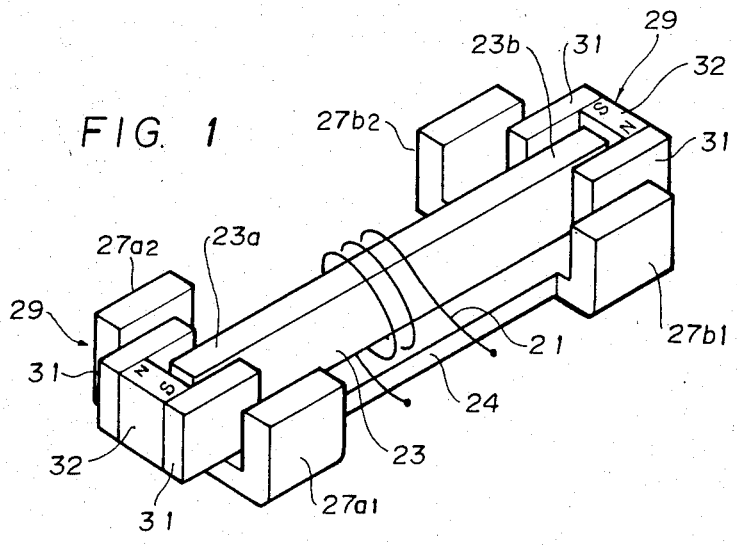
FIG. 1 is a schematic perspective view of the main components of the preferred embodiment of the electromagnetic relay according to the present invention.

The present invention will now be described with reference to the preferred embodiment thereof, and with reference to the appended drawings. FIG. 1 shows in schematic perspective view the essential elements of said preferred embodiment of the electromagnetic relay according to the present invention, and in FIG. 3 there is shown a plan view of the actual device (with its cover removed). An iron core 23 is fitted through the middle of a spool 22 on which an electromagnetic coil 21 is wound. The two ends 23*a* and 23*b* of this iron core 23 project out from the ends of the spool 22. A yoke member 24 is provided below the spool 22 (which in fact is fixed thereto although this is not shown in the figures) and the two ends of this yoke member 24 turn upwards as shown in FIG. 1, each being formed in two pole pieces 27*a*1, 27*a*2 and 27*b*1, 27*b*2. The two pole pieces 27*a*1 and 27*a*2 are positioned on opposite sides of the end 23*a* of the iron core 23 with gaps therebetween, and similarly the other two pole pieces 27*b*1 and 27*b*2 are on opposite sides of the other end 23*b* of the iron core 23 with gaps therebetween. The entire integrally fixed assembly of the coil 21, the spool 22, the iron 23, and the yoke member 24 is fixed to a base 28 of the relay, best seen in FIG. 4 which is a sectional view of FIG. 3 along a plane shown by the arrows A—A in FIG. 3.

Figure 2:
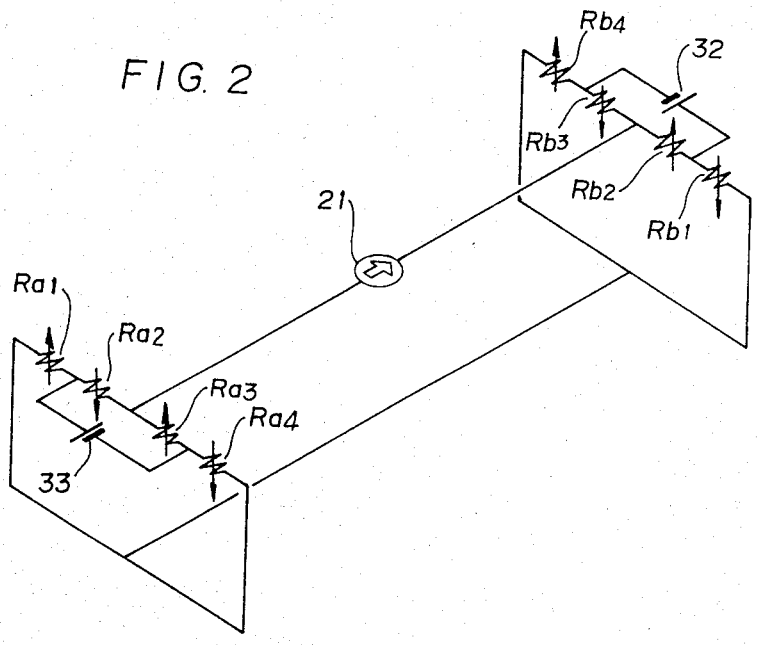
FIG. 2 is a perspective view of the magnetic circuit of said preferred embodiment.

Two armature pieces 29 are each made up by two plate iron members 31 being fixed on opposite ends which define opposite poles of a plate shaped permanent magnet 32, in a generally C-shaped configuration, so that one of the plate members 31 is magnetized to be a north pole and the other is magnetized to be a south pole. Each of these two armature pieces 29 is fixed to one of the ends of a connecting member 30 (see FIG. 5) and projects downwards therefrom, with each of the plate iron members 31 being inserted into one of the gaps between one side of one end of the iron core 23 and one of the pole pieces 27 of the yoke 24, as best shown in FIG. 1. As will be explained shortly, the connecting member 30 can movwe in the direction transverse to the longitudinal axis of the coil 21 and the iron core 23. Further, particularly according to the concept of the present invention, the armature pieces 29 are fixed to the connecting member 30 with the pole of their permanent magnets 32 oriented in opposite directions. FIG. 2 shows an equivalent magnetic circuit for this construction: in this figure, the magnetic resistances of the gaps between the ends of the iron core 23 and the pole pieces 27 of the yoke member 24 and the iron members 31 are denoted by Ra1 through Ra4 and Rb1 through Rb4.

The electromagnetic relay construction shown can be applied either to a single stable type relay or to a latch type relay. In either case, sheet springs 47 (two on each side) are interposed betwen the sides of the connecting member 30 and rising portions 46 of the sides of the base 28 of the relay, with the one ends of the springs 47 fixed to said sides of said connecting member 30 by rivets or the like.

Contacts are provided for being opened and closed by the movement of the connecting member 30, as follows. Contact chambers 35 are provided on both the sides of the spool 22, being defined and protected by side walls 33 and end walls 34 attached to the base 28, and along the central line of each of these chambers 235 there are provided, in order, an A contact 40 near its one end, a common contact 37 near its center, and a B contact 41 near its other end. These contacts are each rods protruding vertically from the floor of the chamber 35, and they extend out from the bottom of the electromagnetic relay as connection terminals: the A contact 40 extends as an A terminal 38, the common contact 37 extends as a common terminal 36, and the B contact 41 extends as a B terminal 39. On each of the side walls 33 of the chambers 35 there are provided, opposing the contacts 40, 37, and 41, ground contacts 44 (six in each chamber 35, therefore). These ground contacts 44 are all connected to a ground terminal 45 which also extends out from the bottom of the electromagnetic relay as a connection terminal. And terminals 48 are provided for providing supply of actuating electrical energy to the coil 21.

Two contact pieces 42 are fixed along each side of the underside of the connecting member 30, by fixing members 43; these contact pieces 42 lie in the chambers 35, and are somewhat springy. For the upper side in FIG. 5 of the connecting member 30, one of the contact pieces 42 extends along from the A contact 40 to the common contact 37, lying to the outside of said contacts, and the other of said contact pieces 42 extends along from the common contact 37 to the B contact 41, lying to the inside of said contacts; and for the lower side in FIG. 5 of the connecting member 30, one of the contact pieces 42 extend along from the A contact 40 to the common contact 37, lying to the inside of said contacts, and the other of said contact pieces 42 extends along from the common contact 37 to the B contact 41, lying to the outside of said contacts. Thus, when the connecting member 30 is shifted in the upwards direction in FIG. 5, each of the B terminals 39 of the electromagnetic relay is electrically connected to its corresponding common terminal 36 via the B contact 41, the contact piece 42, and the common contact 37, and the A terminals 38 are disconnected from the common terminals 36; whereas when the connecting member 30 is shifted in the downwards direction in FIG. 5, each of the A terminals 38 of the electromagnetic relay is electrically connected to its corresponding common terminal 36 via the A contact 40, the contact piece 42, and the common contact 37, and the B terminals 39 are disconnected from the common terminals 38.

Figure 5:
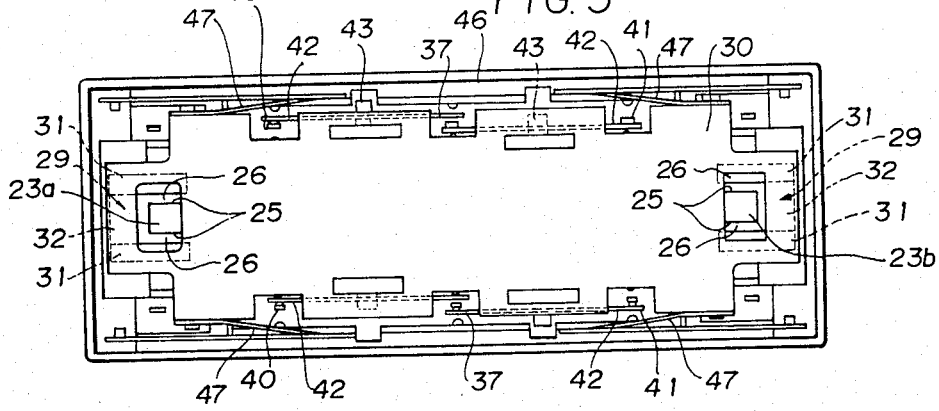
FIG. 5 is a plan view of the inside of said preferred embodiment with said connecting member in place.

If the relay is in fact to be a single stable type relay, then the sheet springs 47 on one side of the member 30, for example the upper side in FIG. 5, are made weaker than those on the other side, exemplarily the lower side, so that the member 30 is biased to one side, exemplarily the upper side in FIG. 5, and thus in the non energized state of the electromagnetic coil 21 each of the B terminals 39 of the electromagnetic relay is electrically connected to its corresponding common terminal 36, and the A terminals 38 are disconnected from the common terminals 36. In this case, when the coil 21 is energized, it should be so energized that, referring to FIG. 3 for the polarity of the magnets, a north pole is developed on the left end of the iron core 23 while a south pole is developed on the right end thereof. In this case, corresponding to the shown polarities of the permanent magnets 32, it will be clear that both ends **23*a* and 23*b* of the iron core 23 will attract the iron plates 31 above them in the figure and will repel the iron plates 31 below them in the figure, and hence the armature pieces 29 will both be impelled downwards in the figure, thus moving the connection member 30 smoothly and straight downwards by overcoming the spring action of the spring pieces 47 so as to disconnect the B terminals 39 from the common terminals 36 and simultaneously to connect the A terminals 38 to said common terminals 36. This occurs in a symmetric fashion with respect to the center of gravity of the electromagnetic relay, thus not generating any off center jerking force or torque which could loosen the connection of the relay or of the terminals thereof. And when the energization of the coil 21 is terminated the action of the spring pieces 47 restores the connecting member 30 and the armature pieces 29 mounted thereon to their original upwards displaced positions, because in this case the action of the spring pieces 47 is arranged to be stronger than the attraction of the upper iron plate members 31 for the ends of the iron core 23 caused by the permanent magnets 32** alone. This reverse switching action again occurs without developing any off center jerking forces on the electromagnetic relay.

Figure 3:
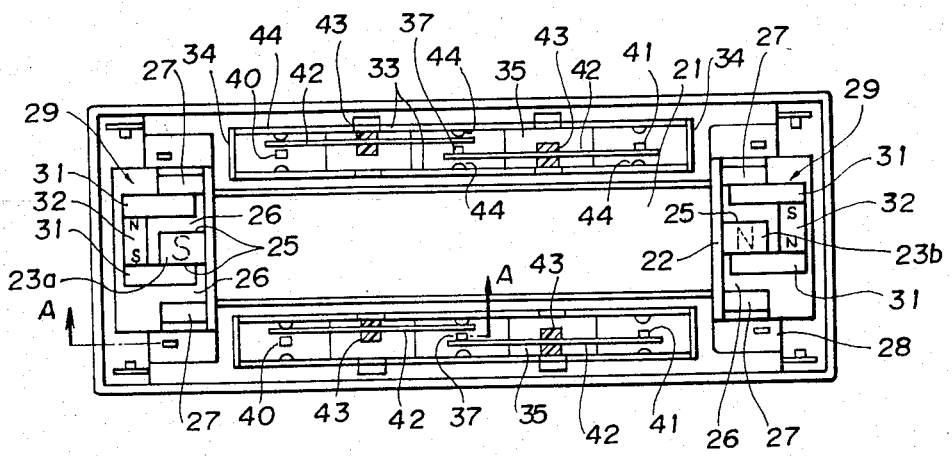
FIG. 3 is a plan view of the inside of said preferred embodiment, with a connecting member removed.
Figure 4:
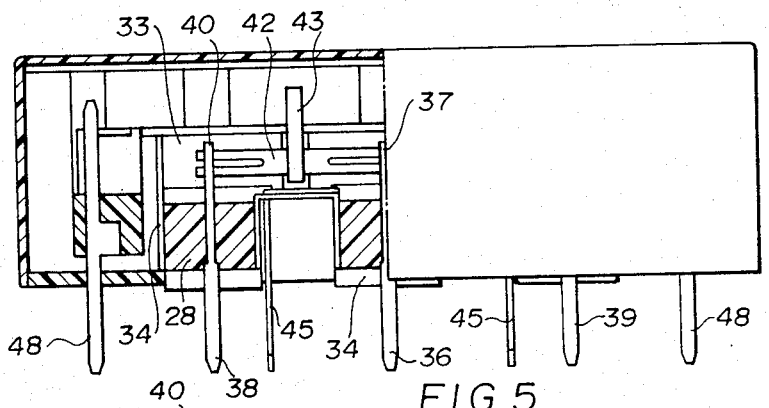
FIG. 4 is a sectional view taken in a plane shown by the arrows A—A in FIG. 3.

On the other hand, if the relay is in fact to be a latching type relay, then the sheet springs 47 on both of the sides of the member 30 are made of roughly the same strength, so that when the coil 21 is not energized, if there were no permanent magnets 32, the connecting member 30 would be biased approximately to the center of its transverse travel, and no connection would be made between any of the terminals of the relay. Also, the sheet springs 47 are arranged to be relatively weaker than in the case described above, so that, since in fact the permanent magnets 32 are incorporated, when the coil 21 is not energized, the connecting member 30 is positioned in one position or the other, either upwards or downwards, according as to which way the coil 21 was last energized. If for example the connecting member 30 is currently positioned in the upwards direction as seen in FIGS. 3 to 5, then each of the B terminals 39 of the electromagnetic relay is electrically connected to its corresponding common terminal 36, and the A terminals 38 are disconnected from the common terminals 36, as specified above. From this state, if the coil 21 is energized in the direction which makes the left end of the iron core 23 into a north pole and the right end of the iron core 23 into a south pole, then the connecting member 30 does not move. On the other hand, if from this state the coil 21 is energized in the opposite direction which makes the left end of the iron core 23 into a south pole and the right end of the iron core 23 into a north pole as suggested in FIG. 3, then in a similar fashion to that described above both ends **23*a* and 23*b* of the iron core 23 will attract the iron plates 31 above them in the figure and will repel the iron plates 31 below them in the figure, and hence again the connection member 30 will be moved smoothly and straight downwards by overcoming the spring action of the spring pieces 47 so as to disconnect the B terminals 39 from the common terminals 36 and simultaneously to connect the A terminals 38 to said common terminals 36. Again, this occurs in a symmetric fashion with respect to the center of gravity of the electromagnetic relay, thus not generating any off center jerking force or torque which could loosen the connection of the relay or of the terminals thereof, so this switching action again occurs without developing any off center jerking forces on the electromagnetic relay. On the other hand, in this case when the energization of the coil 21 is terminated the action of the spring pieces 47 is not sufficient to move the connecting member 30 and the armature pieces 29 mounted thereon to their original upwards displaced positions, because of the attraction of the upper iron plate members 31 for the ends of the iron core 23 caused by the permanent magnets 32 which is stronger than the action of the sheet springs 47, and so the connecting member 30 and the armature pieces 29 remain in their downward position and the contact situation remains as described. This will be the case until the coil 21 is energized in the direction which makes the left end of the iron core 23 into a north pole and the right end of the iron core 23 into a south pole, i.e. in the opposite direction to the previous one, when the connecting member 30 and the armature pieces 29** will be moved back to their original upwards positions. Thus, in summary, the action of the relay is that of a flip-flop device.

As described above, because the construction of this relay is symmetrical about its center of gravity, no off center jerking forces are caused when it is switched. Thus no unbalanced torque is generated, and accordingly no problems arise with regard to the fixing of the relay to a printed circuit board, and the risk that the fixing of the relay should become loosened is prevented. Further, this construction is accomplished without substantially increasing the bulk or the length of the relay. Yet further, since no crimped connection occurs between the iron core 23 and the yoke member 24, no risk occurs of bad connection therebetween deteriorating the quality of the magnetic circuit, and thus the shown construction is much better than that of the described prior art from the point of view of performing simple and reliable construction at a cheap cost.

Although the present invention has been shown and described with reference to the preferred embodiment thereof, and in terms of the illustrative drawings, it should not be considered as limited thereby. Various possible modifications, omissions, and alterations could be conceived of by one skilled in the art to the form and the content of any particular embodiment, without departing from the scope of the present invention.

What is claimed is:

1. An electromagnetic relay, comprising:

(a) a core made of magnetic material;

(b) an electromagnetic coil wound around said core so that the two ends of said core project therefrom and constitute core end poles;

(c) a yoke extending generally parallel to said core, each end of the said yoke being formed with two poles pieces which extend towards the corresponding end pole of said core so as to lie one on each side thereof with a certain gap being defined therebetween;

(d) a connecting member extending generally parallel to said core and said yoke and mounted so as to be movable transversely to its longitudinal axis;

(e) means for establishing and breaking electrical connection according to movement of said connecting member transversely to its longitudinal axis; and (f) two armature pieces, one for each end of said core, both fixed to said connecting member, and each comprising a permanent magnet plate and two plates of magnetic material fixed to said permanent magnet plate so as generally to form a C shape with one of said magnetic material plates being magnetized to be a north pole and the other being magnetized to be a south pole, each of the two plates of magnetic material being inserted on one side of said end of said core between the side of said end of said core and the opposing one of said pole pieces of said yoke into said gap therebetween;

(g) the directions of magnetization of said armature pieces being oppositely oriented.

2. An electromagnetic relay according to claim 1, wherein in each of said armature pieces said plates of magnetic material are fixed to the north and the south pole of said permanent magnet piece.

3. An electromagnetic relay according to claim 1, further comprising means for biasing said connection member in the direction transverse to its longitudinal axis.

4. An electromagnetic relay according to claim 3, wherein said biasing means is strong enough to remove said plates of magnetic material from said ends of said core, when said coil is not energized.

5. An electromagnetic relay according to claim 3, wherein said biasing means is not strong enough to remove said plates of magnetic material from said ends of said core, when said coil is not energized.

* * * * *